US008262206B2

(12) United States Patent
Umeda

(10) Patent No.: US 8,262,206 B2
(45) Date of Patent: Sep. 11, 2012

(54) INKJET PRINTER WITH VARIABLE SIZE TANKS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 810 days.

(21) Appl. No.: 12/128,347

(22) Filed: May 28, 2008

(65) Prior Publication Data

US 2008/0297570 A1 Dec. 4, 2008

(30) Foreign Application Priority Data

May 28, 2007 (JP) ..... 2007-140535

(51) Int. Cl.
*B41J 2/175* (2006.01)

(52) U.S. Cl. ..... 347/85; 347/86; 347/87

(58) Field of Classification Search ..... 347/85–87
See application file for complete search history.

(56) References Cited

U.S. PATENT DOCUMENTS

| | | | | |
|---|---|---|---|---|
| 4,880,135 | A * | 11/1989 | Neou | 220/721 |
| 6,293,662 | B1 * | 9/2001 | Shihoh et al. | 347/86 |
| 7,240,999 | B2 * | 7/2007 | Kumagai et al. | 347/85 |
| 2003/0007045 | A1 * | 1/2003 | Yoshida et al. | 347/86 |
| 2006/0091062 | A1 * | 5/2006 | Akahori et al. | 210/448 |
| 2008/0018721 | A1 | 1/2008 | Umeda | |

FOREIGN PATENT DOCUMENTS

| | | | |
|---|---|---|---|
| JP | 06031933 | A * | 2/1994 |
| JP | 09-113668 | | 5/1997 |
| JP | 09-258341 | A | 10/1997 |
| JP | 10306779 | A * | 11/1998 |
| JP | 2004251198 | * | 9/2004 |
| JP | 2004251198 | A | 9/2004 |
| JP | 2004-358918 | A | 12/2004 |
| JP | 2004358918 | * | 12/2004 |
| JP | 2005083250 | * | 3/2005 |
| JP | 2005083250 | A | 3/2005 |
| JP | 2008-012680 | A | 1/2008 |

OTHER PUBLICATIONS

Notice of Reasons for Rejection for Japanese patent application No. 2007-140535 mailed Nov. 15, 2011.

* cited by examiner

*Primary Examiner* — Ellen Kim
(74) *Attorney, Agent, or Firm* — Banner & Witcoff, Ltd.

(57) ABSTRACT

An inkjet printer includes a recording head configured to eject ink onto a recording medium, an ink tank configured to store the ink to be supplied to the recording head, the ink tank having an expandable and contractible bellows portion, and at least one deformation-preventing member configured to contact an outer surface of the bellows portion and configured to prevent the ink tank from deforming in a direction intersecting with an expanding and contracting direction in which the ink tank expands and contracts.

20 Claims, 7 Drawing Sheets

INKJET PRINTER WITH VARIABLE SIZE TANKS

CROSS REFERENCE TO RELATED APPLICATION

This application claim priority to Japanese Patent Application No. 2007-140535, filed May 28, 2007, whose contents are expressly incorporated herein by reference.

BACKGROUND

1. Technical Field

One or more aspects of the present invention relate to an inkjet printer having a subtank capable of expansion and contraction.

2. Description of the Related Art

For example, a conventional inkjet printer includes a bellows-like expandable and contractible subtank that is positioned in an ink path extending between a main tank and a recording head. The subtank temporarily stores ink so as to smoothen the ink supply pressure that varies in accordance with the amount of ink remaining in the main tank.

If a foreign substance other than ink, for example, air or dust enters a recording head, ink discharging failure occurs. Accordingly, the present inventor considered and made a prototype of a positive-pressure purging type inkjet printer in which a foreign substance was removed together with ink from a recording head by compressing and contracting a subtank.

In order to reliably remove the foreign substance from the recording head, it is beneficial to generate a relatively high ink pressure. However, if the ink pressure increases, the pressure in the subtank increases, and the subtank bulges out, the ink pressure decreases and sufficient positive-pressure purging is difficult.

This problem can be solved by forming the subtank of a highly rigid material or by forming the subtank in a shape that provides high rigidity. Unfortunately, this solving method is hardly adequate because the subtank itself is difficult to deform and a great force is needed to contract the subtank.

SUMMARY

In view of the above-described problems, one advantage of one or more aspects of the invention relate to preventing the bulging of a subtank without hindering expansion and contraction of the subtank.

An inkjet printer according to an aspect of the present invention includes a recording head configured to eject ink onto a recording medium; an ink tank configured to store ink to be supplied to the recording head and having an expandable and contractible bellows portion; and a deformation-preventing member positioned on an outer peripheral surface of the bellows portion and configured to prevent the ink tank from deforming in a direction intersecting with an expanding and contracting direction in which the ink tank expands and contracts.

According to this aspect of the present invention, bulging of the subtank can be prevented without hindering expansion and contraction of the subtank.

Preferably, the deformation-preventing member is disposed at a position such as to equally divide the bellows portion in the expanding and contracting direction.

When the bellows portion bulges out, root portions more easily deform. When the root portions bulge, the ink pressure greatly decreases. Therefore, it is preferable that the deformation-preventing member be disposed in a root portion of the bellows portion. This can effectively prevent deformation of the subtank and a decrease in ink pressure.

A section of the deformation-preventing member facing the bellows portion may have a contact portion such that a dimension thereof parallel to the expanding and contracting direction decreases as being closer to the bellows portion. This can prevent the deformation-preventing member from hindering contraction of the bellows portion.

Preferably, the contact portion is tapered, and a taper angle of the contact portion is less than or equal to an angle of the root portion of the bellows portion formed when the bellows portion is compressed maximally.

DETAILED DESCRIPTION

An inkjet printer according to an embodiment of the present invention is applied to an inkjet printer of a station supply type. An inkjet printer of the station supply type according to the embodiment of the present invention will be described below with reference to the drawings.

It is noted that various connections are set forth between elements in the following description. It is noted that these connections in general and, unless specified otherwise, may be direct or indirect and that this specification is not intended to be limiting in this respect.

1. Description of the Drawings

Figure 1:
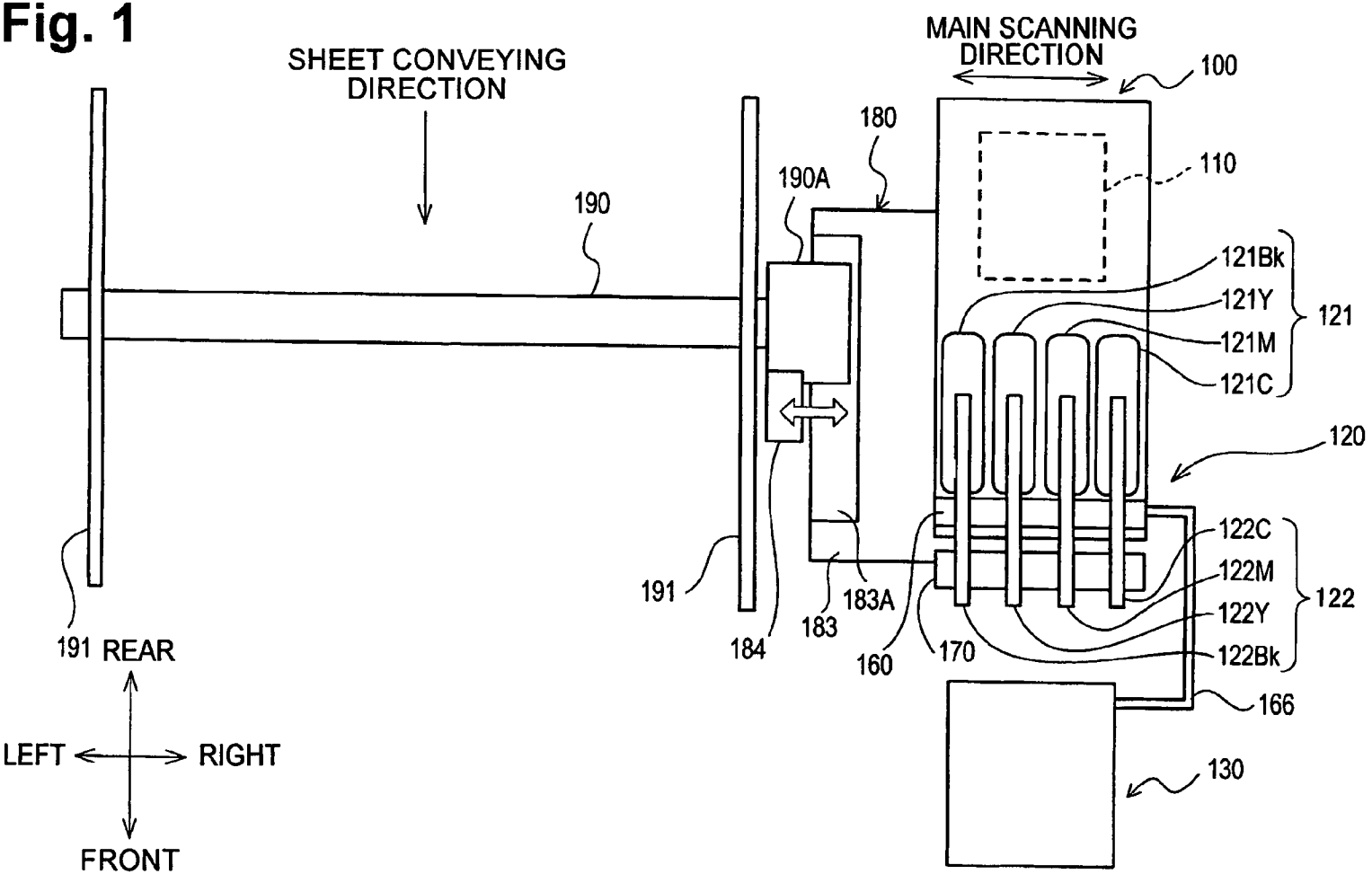
FIG. 1 is a schematic top view of an image forming unit in an inkjet printer according to an embodiment of the present invention.
Figure 2A:
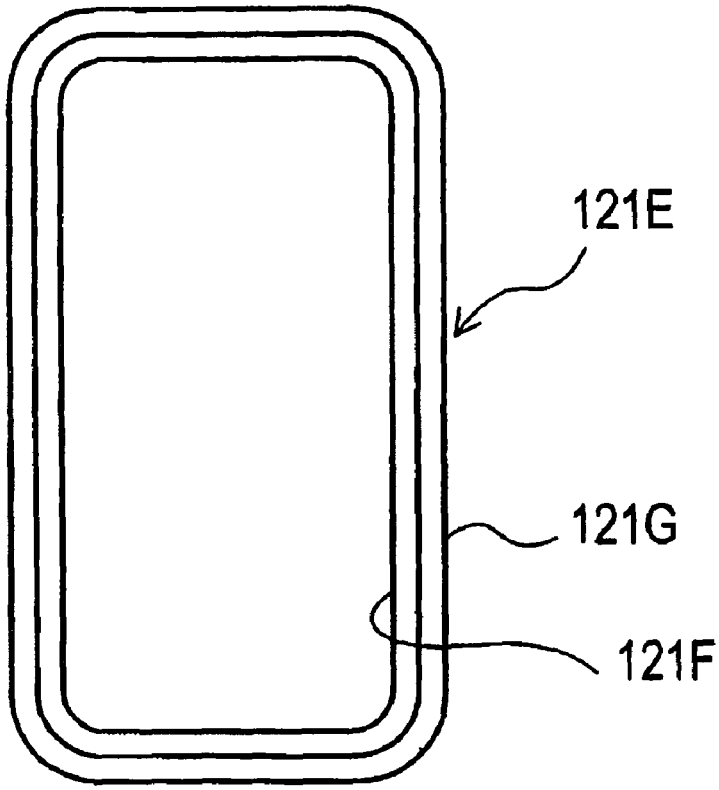
FIG. 2A is a front view of a deformation-preventing ring.
Figure 2B:
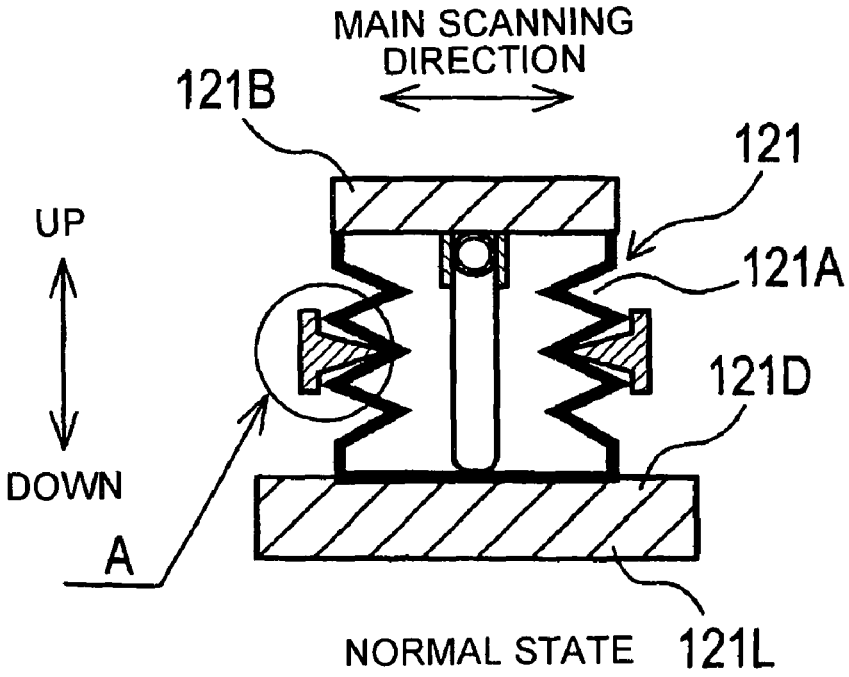
FIGS. 2B and 2C are explanatory views showing a state in which the deformation-preventing ring is mounted on a subtank.
Figure 2C:
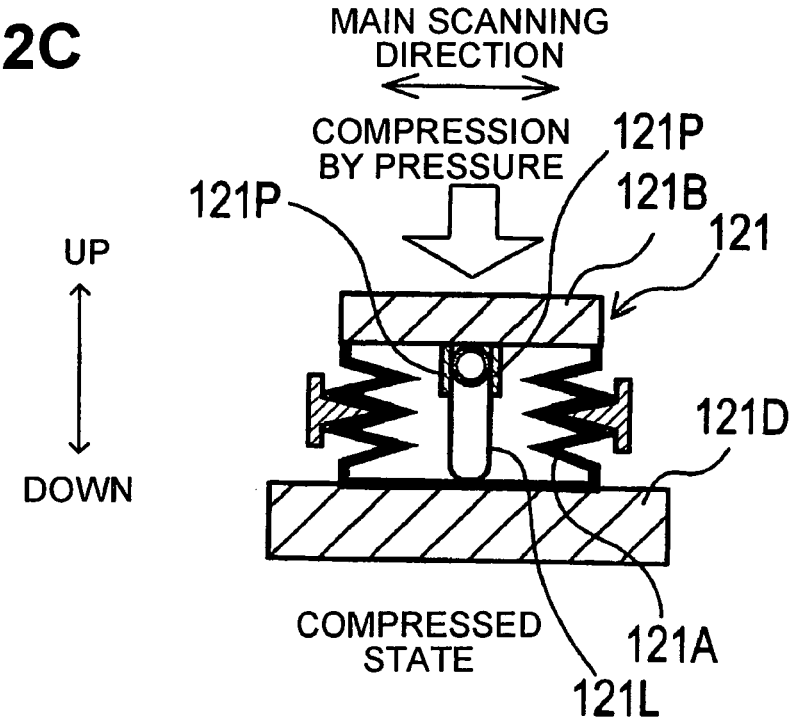
Figure 2D:
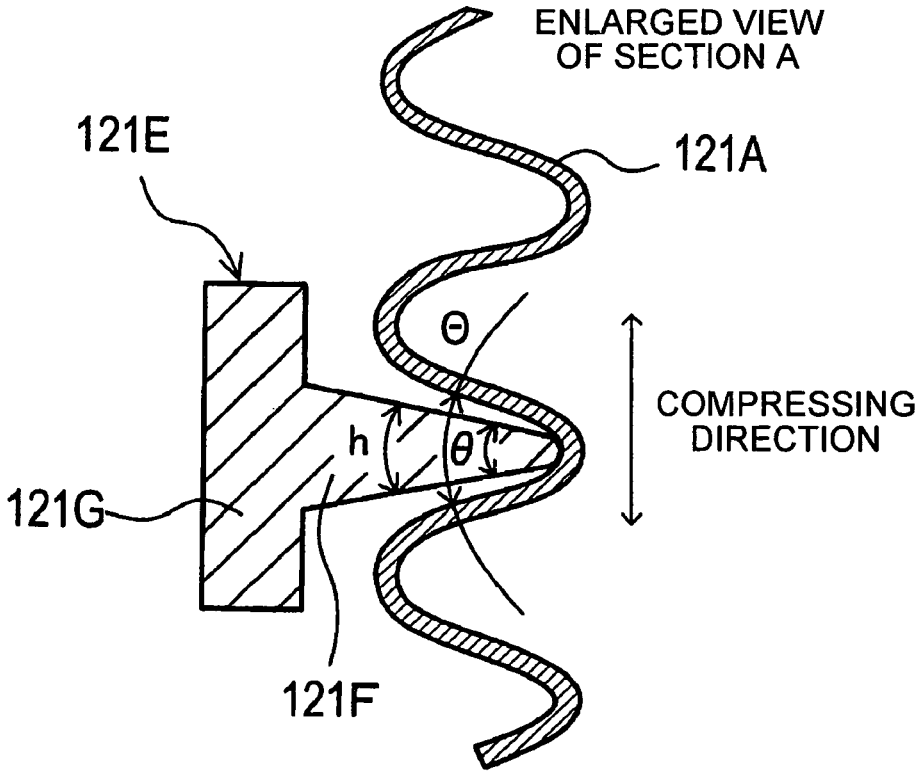
FIG. 2D is an enlarged view of a section A shown in FIG. 2B.

FIG. 1 is a schematic top view of an image forming section in the inkjet printer according to this embodiment. FIG. 2A is a front view of a deformation-preventing ring 121E, FIGS. 2B and 2C are explanatory views showing a state in which the deformation-preventing ring 121E is mounted on a subtank 121, and FIG. 2D is an enlarged view of a section A shown in FIG. 2B. FIG. 2B shows a stretched state (normal state) of the subtank 121, and FIG. 2C shows a compressed state of the subtank 121.

Figure 3A:
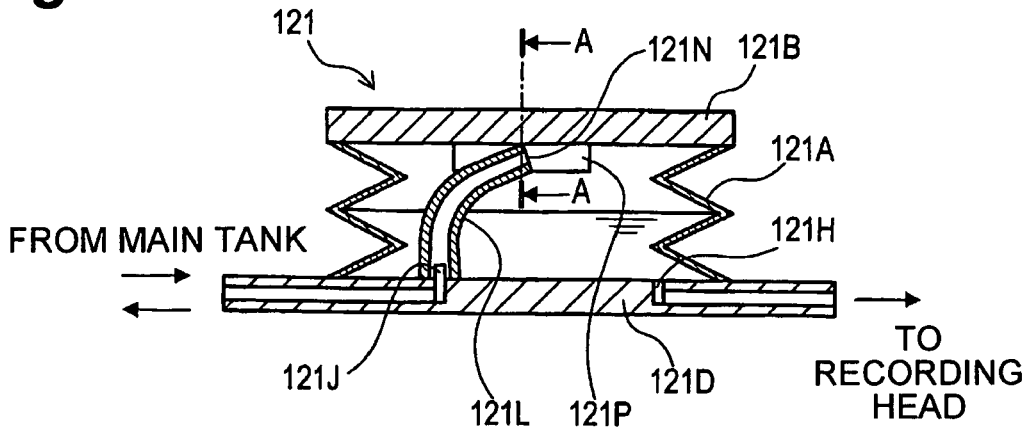
FIGS. 3A and 3C are cross-sectional views of the subtank.
Figure 3B:
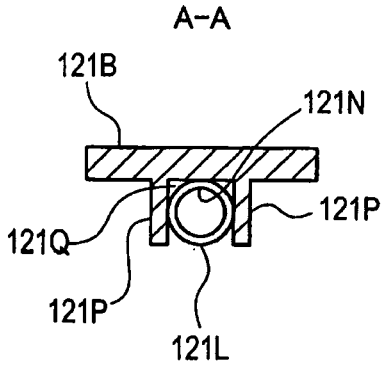
FIG. 3B is a cross-sectional view, taken along line A-A in FIG. 3A.
Figure 3C:
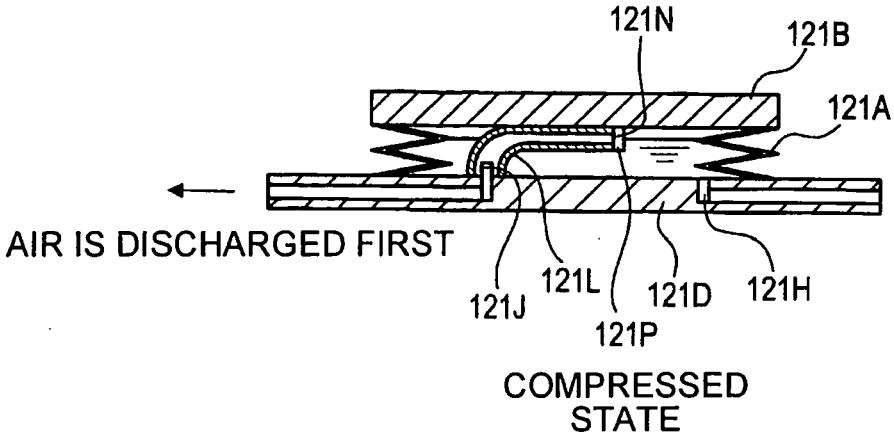
Figure 4A:
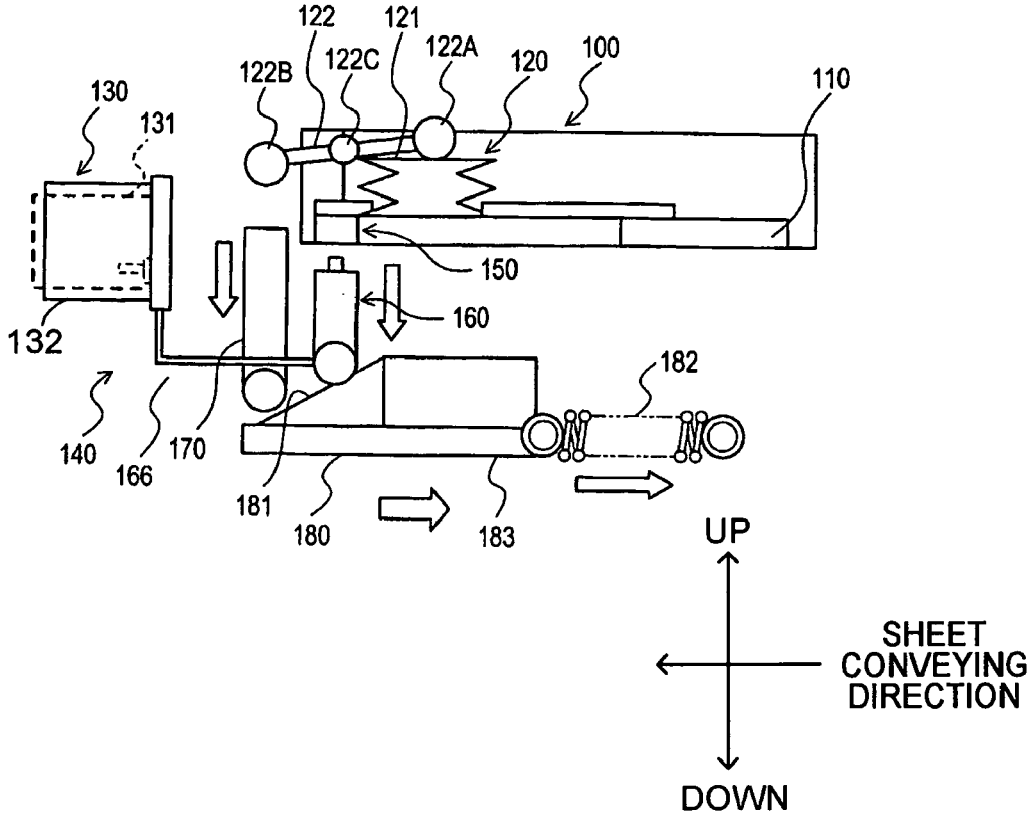
FIG. 4A is an explanatory view showing an ink supply operation.
Figure 4B:
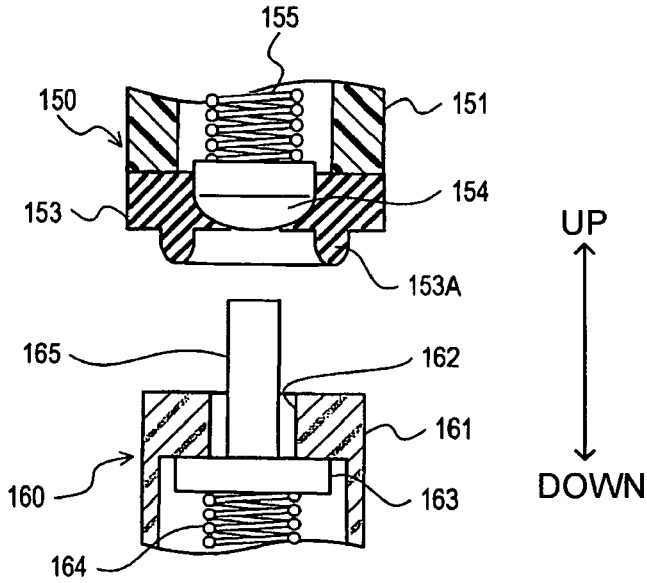
FIG. 4B is an explanatory view showing the operations of joint valves during the ink supply operation.
Figure 5A:
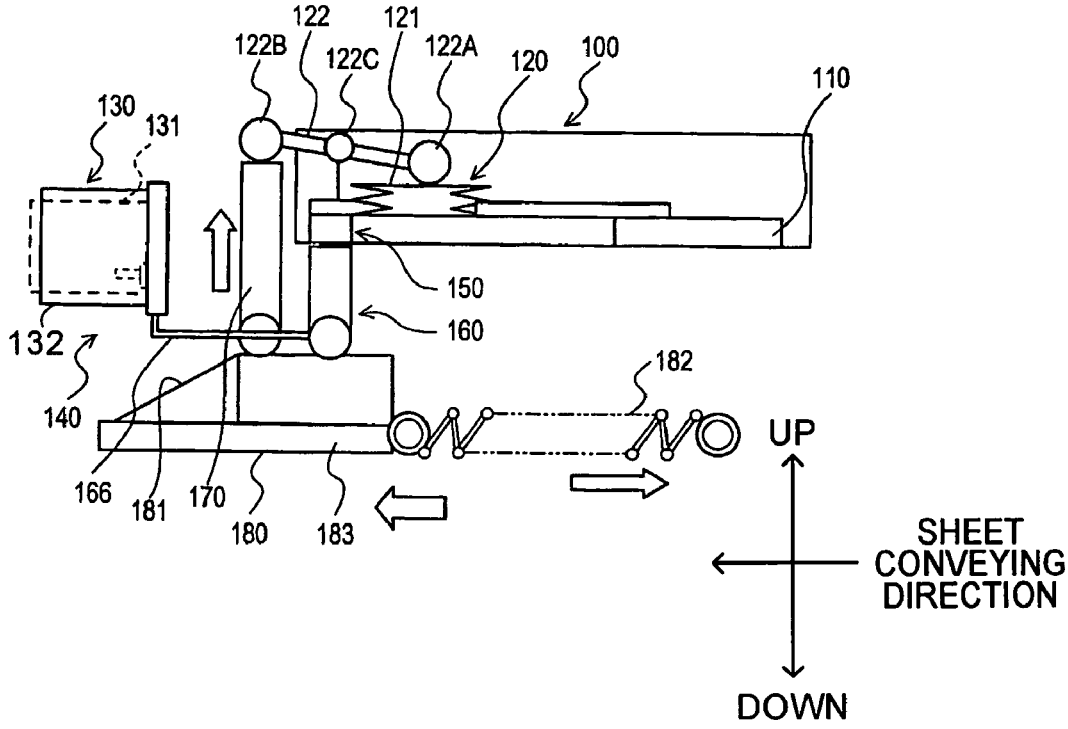
FIG. 5A is an explanatory view showing the ink supply operation.
Figure 5B:
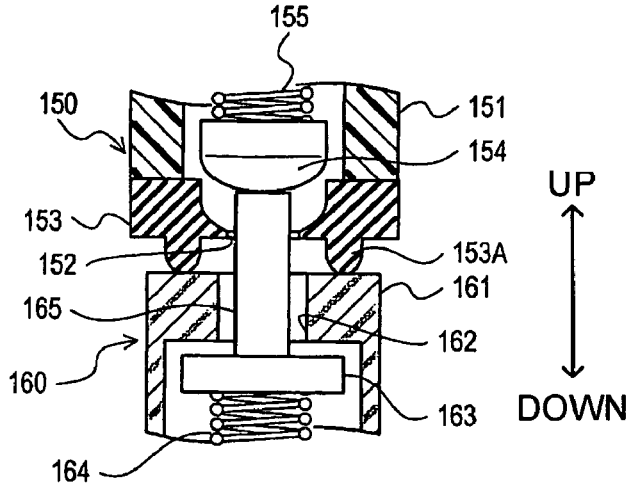
FIG. 5B is an explanatory view showing the operations of joint valves during the ink supply operation.
Figure 6:
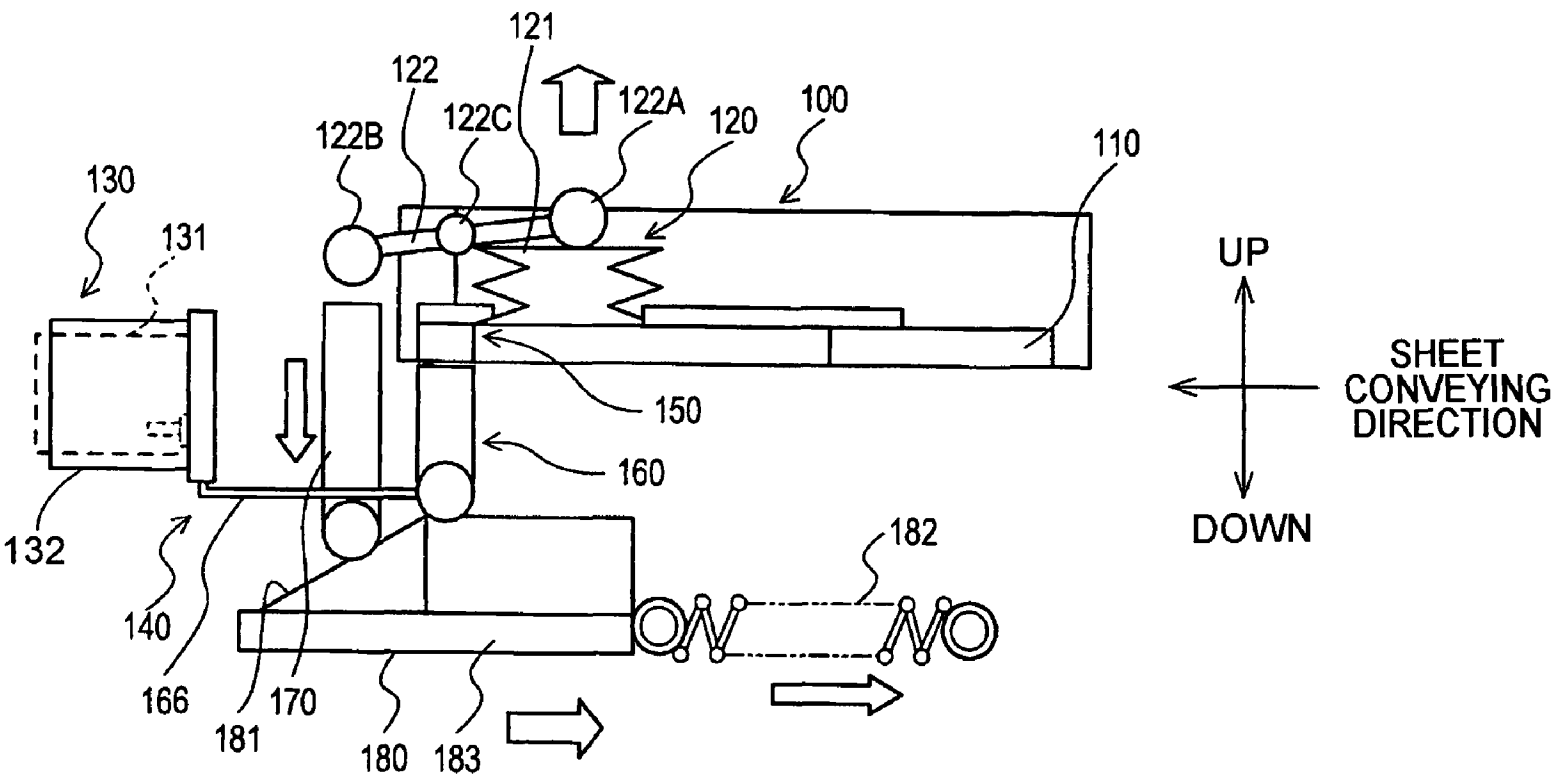
FIG. 6 is an explanatory view showing the ink supply operation.

FIGS. 3A and 3C are cross-sectional views of the subtank 121, and FIG. 3B is a cross-sectional view, taken along line A-A in FIG. 3A. FIGS. 4A, 5A, and 6 are explanatory views showing an ink supply operation, and FIGS. 4B and 5B are explanatory views showing an operation of a joint valve during the ink supply operation.

2. Outline of Inkjet Printer According to the Embodiment

As is well known, an inkjet printer forms an image on a recording medium such as a recording sheet (hereinafter referred to as a sheet) by ejecting minute ink droplets onto the sheet. Further, the inkjet printer forms various color images by superimposing a plurality of colors such as cyan, magenta, yellow, and black.

In a station supply method, a subtank 121 and a main tank unit 130, which will be described below, are connected when ink is supplied to the subtank 121, and are disconnected when ink is not being supplied to the subtank 121, for example, during image formation.

In this embodiment, when the amount of ink remaining in the subtank 121 becomes less than or equal to a predetermined amount, the main tank unit 130 and the subtank 121 are connected, and ink is supplied to the subtank 121. When the amount of remaining ink is more than the predetermined amount, the main tank unit 130 and the subtank 121 are disconnected.

3. Recording Head Unit

In FIG. 1, a recording head unit (carriage) 100 includes a recording head 110 for ejecting ink droplets onto a sheet, and a subtank unit 120 for supplying ink to the recording head 110. During image formation, the recording head unit 100 is scanned (reciprocates) in a direction orthogonal to a sheet conveying direction and parallel to a recording surface of the sheet (in the right-left direction in FIG. 1), that is, in a main scanning direction.

A plurality of nozzles (not shown) for discharging different color inks are positioned on a surface of the recording head 110 facing a conveyed sheet. These nozzles are generally arranged in lines parallel to the sheet conveying direction.

The subtank unit 120 includes a plurality of subtanks 121C, 121M, 121Y, and 121Bk arranged in series in the main scanning direction, and push levers 122C, 122M, 122Y, and 122Bk for respectively pushing the subtanks 121C, 121M, 121Y, and 121Bk.

Incidentally, the subtank 121C is filled with cyan (C) ink, the subtank 121M is filled with magenta (M) ink, the subtank 121Y is filled with yellow (Y) ink, and the subtank 121Bk is filled with black (Bk) ink.

Since the subtanks 121C, 121M, 121Y, and 121Bk are the same except in the color of ink stored therein, they will be generically named subtanks 121 below. Also, since the push levers 122C, 122M, 122Y, and 122Bk are the same except in pushing the different subtanks 121, they will be generically named push levers 122 below.

As shown in FIG. 4A, each push lever 122 serves as a push means that is pivotally connected at one longitudinal end 122A to an upper end of the subtank 121. The other longitudinal end 122B of the push lever 122 is disposed outside an outer edge of the recording head unit 100. A support portion 122C is positioned between the longitudinal ends 122A and 122B of the push lever 122 so as to support the push lever 122 pivotally. The support portion 122C is fixed to a main body of the recording head unit 100.

4. Subtank

The subtank 121 can elastically expand and contract in a direction orthogonal to the main scanning direction and the sheet conveying direction (in the up-down direction in this embodiment). More specifically, as shown in FIGS. 2B and 3A, the subtank 121 includes an expandable and contractible bellows portion 121A, a top plate portion 121B that closes an upper end of the bellows portion 121A in an expanding and contracting direction, and a bottom plate portion 121D that closes a lower end of the bellows portion 121A in the expanding and contracting direction.

The expanding and contracting direction of the subtank 121 does not need to precisely coincide with the up-down direction. For instance, it may be at an angle of about 45 degrees to the up-down direction.

As shown in FIG. 1, the cross section of the subtank 121 intersecting with the expanding and contracting direction of the bellows portion 121A may be shaped like a rectangle having gently arc-shaped corners. In this embodiment, the sheet conveying direction coincides with the long side of the subtank 121, and the main scanning direction coincides with the short side of the subtank 121. A plurality of subtanks 121 are arranged in series in the main scanning direction.

The bellows portion 121A is an ink tank portion shaped like a bellows and formed of a highly strong and/or durable material such as PP (polypropylene), PE (polyethylene), or an elastomer. As shown in FIG. 2B, a deformation-preventing ring 121E serving as a deformation-preventing member is mounted on an outer peripheral surface of the bellows portion 121A. The deformation-preventing ring 121E prevents the subtank 121 (bellows portion 121A) from deforming in the directions intersecting with the expanding and contracting direction (in the main scanning direction and the sub-scanning direction in this embodiment).

The deformation-preventing ring 121E may be shaped like a substantially rectangular ring that conforms to the cross-sectional shape of the bellows portion 121A, as shown in FIG. 2A. The deformation-preventing ring 121E may include a contact portion 121F in contact with the outer peripheral surface of the bellows portion 121A, and a reinforcing portion 121G positioned on a side of the contact portion 121F opposite the bellows portion 121A so as to reinforce the contact portion 121F, as shown in FIG. 2D.

In this embodiment, the contact portion 121F and the reinforcing portion 121G are integrally molded from a resin material having a high mechanical strength, for example, POM (polyacetal).

As shown in FIG. 2B, the deformation-preventing ring 121E is mounted at a position such as to equally divide the bellows portion 121A (in two in this embodiment) in the expanding and contracting direction while the contact portion 121F is fitted in a root portion of the bellows portion 121A. It is appreciated that additional deformation-prevention rings 121*b* may be used to further prevent bulging of subtank 121.

The position such as to equally divide the bellows portion 121A in the expanding and contracting direction is not limited to a position such as to precisely equally divide the bellows portion 121A, and may be shifted from the precise position in accordance with the number and size of root portions. That is, the position such as to equally divide the bellows portion 121A refers to a position those skilled in the art visually recognizes as a position that allows equal division, without using a measuring instrument such as vernier calipers.

A section of the contact portion 121F facing the bellows portion 121A is tapered (shaped like a triangle) so that the dimension h parallel to the expanding and contracting direction decreases as being closer to the bellows portion 121A, as shown in FIG. 2D. The taper angle $\theta$ is set to be equal to or less than the angle $\Theta$ of the root portion formed when the bellows portion 121A is compressed maximally.

The materials or shapes of the top plate portion 121B and the bottom plate portion 121D are determined to obtain a flexural rigidity higher than that of the bellows portion 121A so that the top plate portion 121B and the bottom plate portion 121D are prevented from flexural deformation when the top plate portion 121B is pushed by the push lever 122.

As shown in FIG. 3A, the bottom plate portion 121D has a first ink passage port 121H communicating with the recording head 110, and a second ink passage port 121J communicating with the main tank unit 130. The second ink passage port 121J communicates with an upper inner space of the subtank 121 (close to the top plate portion 121B) via a communication tube 121L.

That is, one end of the communication tube 121L is connected to the second ink passage port 121J from inside the subtank 121, and an aperture 121N at the other end thereof is open in the upper part of the subtank 121. In FIG. 3, the deformation-preventing ring 121E is not shown because of space limitations.

The communication tube 121L may be shaped like a cylinder and may be formed of an elastically deformable material such as an elastomer. An upper end of the communication tube 121L is curved so as to be in direct or indirect contact with the top plate portion 121B even when the subtank 121 (bellows portion 121A) is expanded maximally.

For this reason, when the top plate portion 121B is pushed by the push lever 122 and the subtank 121 is thereby contracted, the communication tube 121L is deformed with contraction of the subtank 121. Therefore, the aperture 121N is displaced from the top down with contraction of the subtank 121.

Conversely, when the pushing force of the push lever 122 is removed, the aperture 121N is displaced from the bottom up with expansion of the subtank 121 because of a restoring force of the subtank 121 and a restoring force of the communication tube 121L. That is, in this embodiment, the aperture 121N may always be open in the upper inner space of the subtank 121, regardless of the deformation state of the subtank 121.

As shown in FIGS. 3A and 3B, the top plate portion 121B has two deformation-inducing ribs 121P serving as deformation-inducing means. The deformation-inducing ribs 121P induce deformation of the communication tube 121L so that the aperture 121N approaches the center of the top plate portion 121B with the increasing contraction of the subtank 121.

The deformation-inducing ribs 121P are a pair of wall-shaped members extending from a side of the top plate portion 121B corresponding to a connecting portion between the communication tube 121L and the second ink passage port 121J toward the center of the top plate portion 121B, as shown in FIG. 3A. The aperture 121N of the communication tube 121L is slidably positioned in a substantially angular U-shaped groove 121Q defined by the deformation-inducing ribs 121P and the top plate portion 121B, as shown in FIG. 3B.

The center of the top plate portion 121B refers to a portion of the top plate portion 121B where the moment acting on the top plate portion 121B is balanced. The moment includes, for example, the moment resulting from the force in the expanding and contracting direction applied to the top plate portion 121B by the bellows portion 121A and the moment acting on the top plate portion 121B because of the pressure in the subtank 121.

In this embodiment, the bellows portion 121A can be regarded as substantially equally applying the force to the top plate portion 121B, and the force due to the inner pressure equally acts on the entire top plate portion 121B according to the Pascal's principle. Therefore, the center of the top plate portion 121B coincides with the centroid (where the moment of area is balanced) of the top plate portion 121B.

5. Main Tank Unit

As shown in FIG. 4A, the main tank unit 130 includes a plurality of ink cartridges 131 filled with ink to be supplied to the subtanks 121, and a cartridge casing 132 in which the ink cartridges 131 are detachably mounted.

The ink cartridges 131 may be shaped with a structure having oblong cross-sections, having a width that is smaller than dimensions in the other directions. The ink cartridges 131 are arranged in the horizontal direction in the cartridge casing 132 so that the width direction thereof substantially coincides with the horizontal direction.

6. Station-Type Ink Supply Mechanism

6.1. General Configuration of Station-Type Ink Supply Mechanism

As shown in FIG. 4A, a station-type ink supply mechanism (hereinafter referred to as an ink supply mechanism) 140 includes a subtank-side joint valve 150, a main-tank-side joint valve 160, a pushrod 170 for pushing the end 122B of the push lever 122, and a slide cam 180 for operating the main-tank-side joint valve 160 and the pushrod 170.

The subtank-side joint valve 150, the main-tank-side joint valve 160, the pushrod 170, and the slide cam 180 are positioned for each subtank 121. Since these members are the same in structure among the subtanks 121, the ink supply mechanism 140 for the subtank 121 filled with black ink will be described below as an example.

The subtank-side joint valve 150 is a connecting valve fixed to the main body of the recording head unit 100 and communicating with the subtank 121. As shown in FIG. 4B, a valve cap 153 having a valve port 152 (see FIG. 5B) is mounted in a liquid tight manner on a side of a substantially cylindrical valve housing 151 facing the main-tank-side joint valve 160. The valve port 152 is closed by a valve body 154 movably positioned in the valve housing 151.

In this embodiment, the valve cap 153 is formed of an elastic material such as an elastomer. An annular projection 153A is positioned on a side of the valve cap 153 facing the main-tank-side joint valve 160. The annular projection 153A surrounds the valve port 152, and projects toward the main-tank-side joint valve 160.

A coil spring 155 serves as an elastic means that presses the valve body 154 from inside in a direction such as to close the valve port 152. The initial load and spring constant of the coil spring 155 are set so that the sum (=F1+F2) of a pressing force F1 produced by the pressure in the valve housing 151 so as close the valve body 154 and a pressing force F2 for the valve body 154 produced by the coil spring 155 is substantially equal to or slightly more than a pressing force F3 produced by the atmospheric pressure so as to open the valve body 154.

In this embodiment, the subtank-side joint valve 150 communicates with an upper side of the subtank 121, and the recording head 110 communicates with a lower side of the subtank 121.

When ink is supplied to the subtank 121, the main-tank-side joint valve 160 is connected to the subtank-side joint valve 150 so that the subtank 121 communicates with the ink cartridge 131. As shown in FIG. 4A, the main-tank-side joint valve 160 communicates with the ink cartridge 131 via an ink supply pipe such as a tube 166.

As shown in FIG. 4B, a valve port 162 is positioned on a side of a substantially cylindrical valve housing 161 facing the valve cap 153. The valve port 162 is closed by a valve body 163 movably positioned in the valve housing 161.

A coil spring 164 serves as an elastic means that applies, to the valve body 163, a pressing force in a direction such as to close the valve port 162. A pushrod 165 protrudes toward the subtank-side joint valve 150, and pushes the valve body 154 of the subtank-side joint valve 150 so as to open the valve port 152. The pushrod 165 is positioned integrally with the valve body 163, and is displaced together with the valve body 163.

The slide cam 180 has a cam surface 181 that is in contact with longitudinal ends of the main-tank-side joint valve 160 (valve housing 161) and the pushrod 170 so as to move the main-tank-side joint valve 160 and the pushrod 170 in the longitudinal direction (in the up-down direction in this embodiment).

In order to move the main-tank-side joint valve 160 and the pushrod 170 upward, the slide cam 180 is moved to the left in FIG. 4A by a driving force from a sheet ejection roller 190 that will be described below.

In contrast, in order to move the main-tank-side joint valve 160 and the pushrod 170 downward, the slide cam 180 is moved to the right in FIG. 4A by an elastic force of a return spring 182 while blocking the transmission of the driving force from the sheet ejection roller 190.

The slide cams 180 for the respective subtanks 121 are combined by a base plate 183. As shown in FIG. 1, a rack gear 183A is positioned on a side of the base plate 183 close to the sheet ejection roller 190.

A driving force is transmitted from a gear 190A positioned at a longitudinal end of the sheet ejection roller 190 to the rack gear 183A (base plate 183) by a pinion gear 184. The pinion gear 184 is movable between a position in engagement with the rack gear 183A and a position out of engagement with the rack gear 183A. The position of the pinion gear 184 is switched by an actuator such as an electromagnetic solenoid (not shown).

The sheet ejection roller 190 serves as a conveying means that conveys a sheet toward an ejection port (not shown) after image formation. The sheet is conveyed and ejected between a pair of right and left frames 191.

6.2. Outline of Operation of Ink Supply Mechanism

The ink supply mechanism 140 serves as a station supply means that connects the subtank-side joint valve 150 and the main-tank-side joint valve 160 so as to supply ink to the subtank 121 when the amount of ink remaining in the subtank 121 becomes equal to or less than the predetermined amount.

In this embodiment, when the number of times ink is jetted from the recording head 110 (including the number of times ink is jetted for purging) after the previous operation of supplying ink to the subtank 121 reaches a predetermined number, it is estimated that the amount of ink remaining in the subtank 121 becomes equal to or less than the predetermined amount.

When a control unit (not shown) for controlling the operation of the inkjet printer determines that the amount of ink remaining in the subtank 121 is equal to or less than the predetermined amount, it moves the pinion gear 184 into engagement with the rack gear 183A, and rotates the sheet ejection roller 190.

Since the slide cam 180 is thereby moved to the left in FIG. 5A, the main-tank-side joint valve 160 and the pushrod 170 are pushed upward.

For this reason, as shown in FIG. 5B, the main-tank-side joint valve 160 moves up and the pushrod 165 thereof pushes up the valve body 154 of the subtank-side joint valve 150, so that the valve port 152 is opened.

Simultaneously, the valve body 163 of the main-tank-side joint valve 160 receives, via the pushrod 165, a pushing force in a direction such as to open the valve port 162. Therefore, the valve body 163 moves down, and the valve port 162 is opened so that the subtank 121 communicates with the ink cartridge 131.

On the other hand, since the leading end of the pushrod 170 pushes up the end 122B of the push lever 122, the end 122A of the push lever 122 moves down to compress and crush the subtank 121, as shown in FIG. 5A. For this reason, ink remaining in the subtank 121 is temporarily returned to the ink cartridge 131.

If the subtank 121 is compressed before the main-tank-side joint valve 160 is connected to the subtank-side joint valve 150, when the joint valves 150 and 160 are connected, ink is highly likely to leak from the connecting portion therebetween. Accordingly, in this embodiment, the shape of the cam surface 181 and the operating direction of the slide cam 180 are set so that compression of the subtank 121 starts after connection between the subtank-side joint valve 150 and the main-tank-side joint valve 160 is completed.

If the compression pressure applied to the subtank 121 is excessively high, a meniscus formed at the discharging port of the recording head 110 may be broken. Therefore, the shape of the cam surface 181 and the operating speed of the slide cam 180 are set so that the subtank 121 is compressed by a pressure that does not break the meniscus (for example, 4 kPa or less).

When a predetermined time elapses since the pinion gear 184 is moved into engagement with the rack gear 183A and the sheet ejection roller 190 is rotated, or when the total rotation amount of the sheet ejection roller 190 reaches a predetermined rotation amount, the control unit determines that compression of the subtank 121 is completed. Then, the control unit moves the pinion gear 184 out of engagement of the rack gear 183A, and stops the rotation of the sheet ejection roller 190.

Consequently, the slide cam 180 starts to move to the right in FIG. 6, the pushrod 170 moves down, and the subtank 121 expands by its own restoring force. Therefore, the ink in the ink cartridge 131 is drawn into the subtank 121 so as to fill the subtank 121.

When the slide cam 180 further moves to the right, the pushrod 170 separates from the push lever 122, the subtank-side joint valve 150 and the main-tank-side joint valve 160 are disconnected from each other, and are thereby closed, as shown in FIG. 4.

If the subtank-side joint valve 150 and the main-tank-side joint valve 160 are disconnected while the pushrod 170 is in contact with the push lever 122, ink is highly likely to leak from the connecting portion therebetween. Accordingly, in this embodiment, the shape of the cam surface 181 and the operating direction of the slide cam 180 are set so that the subtank-side joint valve 150 is disconnected from the main-tank-side joint valve 160 after the pushrod 170 separates from the push lever 122.

During image formation, the subtank-side joint valve 150 and the main-tank-side joint valve 160 are not connected and are closed, as shown in FIG. 4. When the ink in the subtank 121 is consumed, the subtank 121 is elastically deformed to contract. Therefore, the pressure in the subtank 121 decreases, and the meniscus formed in the recording head 110 is maintained by the decreased pressure (negative pressure) in the subtank 121.

In this case, if much ink in the subtank 121 is consumed and the pressure in the subtank 121 is excessively decreased, the difference between the atmospheric pressure and the pressure in the subtank 121 excessively increases, and this may break the meniscus.

However, in this embodiment, the initial load and spring constant of the coil spring 155 are set so that the sum (=F1+F2) of the pressing force F1 produced by the pressure in the valve housing 151 so as close the valve body 154 and the pressing force F2 of the coil spring 155 is substantially equal to or slightly more than the pressing force F3 produced by the atmospheric pressure so as to open the valve body 154. Therefore, when the pressure in the subtank 121 excessively decreases, the subtank-side joint valve 150 is opened to increase the pressure.

When the difference between the atmospheric pressure and the pressure in the subtank 121 decreases to a value corresponding to the pressing force of the coil spring 155, the subtank-side joint valve 150 is closed, and the pressure in the subtank 121 is kept at a proper pressure to maintain the meniscus.

That is, the opening and closing of the subtank-side joint valve 150 is automatically controlled so that the difference between the atmospheric pressure and the pressure in the subtank 121 is maintained at the pressure corresponding to the pressing force of the coil spring 155.

7. Characteristics of Inkjet Printer According to the Embodiment

If a foreign substance other than the ink, such as air or dust, enters the recording head 110, ink discharging failure occurs. Accordingly, the inkjet printer according to this embodiment has a positive-pressure purging function of ejecting a foreign substance from the recording head 110 by contracting and compressing the subtank 121 periodically and/or at a user's request.

In order to reliably remove the foreign substance from the recording head 110, it is beneficial to generate a relatively high ink pressure (for example, about 50 kPa or more). However, if the ink pressure increases, the pressure in the subtank 121 increases, and the subtank 121 bulges out, the ink pressure decreases, and sufficient positive-pressure purging is difficult.

This problem can be solved by forming the subtank 121 of a highly rigid material or forming the subtank 121 in a shape that positions high rigidity. However, this solving method is hardly adequate because the subtank 121 itself is difficult to deform and a great force is needed to contract the subtank 121.

In this embodiment, the deformation-preventing ring 121E for preventing the subtank 121 from deforming in the directions intersecting with the expanding and contracting direction is positioned on the outer peripheral surface of the bellows portion 121A. This prevents bulging of the subtank 121 without hindering contraction of the subtank 121.

When the bellows portion 121A bulges out, the root portions more easily deform. When the root portions bulge out, the ink pressure greatly decreases, and therefore, effective positive-pressure purging is difficult. By placing the deformation-preventing ring 121E in the root portion of the bellows portion 121A, as in this embodiment, deformation of the subtank 121 and the decrease in ink pressure can be effectively prevented, and positive-pressure purging can be performed effectively.

Since the contact portion 121F is tapered so that the dimension h parallel to the expanding and contracting direction decreases as being closer to the bellows portion 121A, the deformation-preventing ring 121E is prevented from hindering contraction of the bellows portion 121A.

If the first ink passage port 121H communicating with the recording head 110 is positioned on the upper side of the subtank 121 and the second ink passage port 121J communicating with the main tank unit 130 is positioned on the lower side of the subtank 121, when the subtank 121 is contracted to discharge air from the subtank 121 toward the main tank unit 130, air collected in the upper part of the subtank 121 is supplied to the recording head 110, and only ink collected in the lower part of the subtank 121 is supplied to the main tank unit 130. Consequently, ink discharging failure is more likely to occur.

The operation mode in which the subtank 121 is contracted to discharge air from the subtank 121 toward the main tank unit 130 (hereinafter referred to as an air release mode) is performed periodically or at a user's request, similarly to positive-pressure purging.

In this embodiment, the second ink passage port 121J and the interior of the subtank 121 communicate with each other via the aperture 121N that is displaced from top down with contraction of the subtank 121, as described above. Air always exists in the upper part of the subtank 121, regardless of the deformation state of the subtank 121.

Since the aperture 121N can be open in an air-layer region of the subtank 121, regardless of the deformation state of the subtank 121, air can be reliably discharged from the subtank 121 toward the main tank unit 130.

Since the communication tube 121L elastically deforms with contraction of the subtank 121, the deformed subtank 121 can be restored and reliably expanded by using the elastic force (restoring force) of the communication tube 121L.

The deformation-inducing ribs 121P are positioned to induce deformation of the communication tube 121L so that the aperture 121N approaches the center of the top plate portion 121B with the progress of contraction of the subtank 121. Therefore, the communication tube 121L can be deformed so that the aperture 121N is placed at the center of the top plate portion 121B when the subtank 121 is maximally contracted.

In a case in which the aperture 121N is placed at the center of the top plate portion 121B when the subtank 121 is maximally contracted, restoration of the subtank 121 can be supported while preventing the subtank 121 from tilting.

In this embodiment, both the first ink passage port 121H and the second ink passage port 121J are positioned in the bottom plate portion 121D. If both the first ink passage port 121H and the second ink passage port 121J are positioned in the top plate portion 121B, when the subtank 121 (top plate portion 121B) is pushed by the push lever 122, it tilts because of flexible ink tubes connected to the first ink passage port 121H and the second ink passage port 121J. This makes it difficult to uniformly deform the subtank 121 in the up-down direction.

If the subtank 121 is not uniformly contracted in the up-down direction, the actual amount of contraction is small with respect to the operating amount of the push lever 122, and the compression efficiency decreases. Therefore, the operating efficiency decreases during the pressure-purging mode and the air release mode and when the ink is returned to the main tank unit 130.

In contrast, in this embodiment, both the first ink passage port 121H and the second ink passage port 121J are positioned in the bottom plate portion 121D on which the pushing force of the push lever 122 does not directly act. Therefore, the subtank 121 can be uniformly contracted in the up-down direction, and the operating efficiency is prevented from decreasing during the pressure-purging mode and when the ink is returned to the main tank unit 130.

OTHER EMBODIMENTS

While the first ink passage port 121H and the second ink passage port 121J oppose each other in the above-described embodiment (see FIG. 3A), the present invention is not limited thereto.

While the bellows portion 121A can expand and contract in the up-down direction in the above-described embodiment, the present invention is not limited thereto.

While the communication tube 121L is positioned in the subtank 121 in the above-described embodiment, the present invention is not limited thereto. Alternatively, the communication tube 121L may be omitted.

In this case, there is no need to form both the first ink passage port 121H and the second ink passage port 121J in the bottom plate portion 121D. For example, the first ink passage port 121H may be positioned in the bottom plate portion 121D and the second ink passage port 121J may be positioned in the top plate portion 121B. Conversely, the first ink passage port 121H may be positioned in the top plate portion 121B and the second ink passage port 121J may be positioned in the bottom plate portion 121D. Alternatively, both the first ink passage port 121H and the second ink passage port 121J may be positioned in the top plate portion 121B.

While the communication tube 121L is elastically deformable in the above-described embodiment, the present invention is not limited thereto. For example, the communication tube 121L may be telescopic so as to expand and contract in the axial direction, or may be mounted on the bottom plate portion 121D so as to pivot up and down with the up-down movement of the top plate portion 121B. Alternatively, the communication tube 121L may be formed of a flexible material having little elasticity and the aperture 121N may be connected to the top plate portion 121B.

While the deformation-inducing ribs 121P serve as the deformation-inducing means that induce deformation of the communication tube 121L so that the aperture 121N approaches the center portion in the above-described embodiment, the present invention is not limited thereto. For example, the communication tube 121L may be connected to the second ink passage port 121J while being inclined with respect to the bottom plate portion 121D, or the top plate portion 121B may be positioned with an inclined face that guides the communication tube 121L in the initial deforming direction.

While the deformation-preventing ring 121E is disposed at the position such as to equally divide the bellows portion 121A in two in the above-described embodiment, the present invention is not limited thereto. For example, (n−1)-number of deformation-preventing rings 121E may be positioned on the bellows portion 121A so as to equally divide the bellows portion 121A into n-number of sections. Alternatively, the deformation-preventing ring 121E may be disposed so as not to equally divide the bellows portion 121E.

While the cross section of the subtank 121 is substantially rectangular in the above-described embodiment, for example, it may be circular.

While the deformation-preventing ring 121E is mounted so that the contact portion 121F is fitted in the root portion, the present invention is not limited thereto. For example, the deformation-preventing ring 121E may be mounted to cover a crest portion of the bellows portion 121A.

While the contact portion 121F is tapered in the above-described embodiment, for example, it may be spherical.

While the deformation-preventing ring 121E is annular (O-shaped) in the above-described embodiment, for example, it may be U-shaped or C-shaped.

While the present invention is applied to the inkjet printer of the station supply type in the above-described embodiment, it is not limited thereto.

The present invention is not limited to the above-described embodiment so far as it meets the scope of the claims.

What is claimed is:

1. An inkjet printer comprising:

a recording head configured to eject ink onto a recording medium;

an ink tank configured to store the ink to be supplied to the recording head, the ink tank having an expandable and contractible bellows portion; and at least one deformation-preventing member configured to contact an outer surface of the bellows portion and configured to prevent the ink tank from bulging in a direction intersecting with an expanding and contracting direction in which the ink tank expands and contracts, wherein the at least one deformation-preventing member is supported by the bellows portion such that:

the at least one deformation-preventing member surrounds an outermost portion of the bellows portion, and the at least one deformation-preventing member moves together with the bellows portion when the ink tank expands and contracts.

2. The inkjet printer according to claim 1, wherein the at least one deformation-preventing member divides the bellows portion into n-number of sections, and (n−1)-number of the at least one deformation-preventing member is positioned at least one position substantially equally spaced along the bellows portion, resulting in the n-number of sections.

3. The inkjet printer according to claim 1, wherein the at least one deformation-preventing member is disposed in a root portion of the bellows portion.

4. The inkjet printer according to claim 1, wherein the at least one deformation-preventing member is mounted to cover a crest portion of the bellows portion.

5. The inkjet printer according to claim 1, wherein the at least one deformation-preventing member is annular.

6. The inkjet printer according to claim 1, wherein the at least one deformation-preventing member is U-shaped or C-shaped.

7. The inkjet printer according to claim 4, wherein a section of the at least one deformation-preventing member facing the bellows portion has a contact portion such that a dimension thereof parallel to the expanding and contracting direction decreases in a direction toward an interior of the ink tank.

8. The inkjet printer according to claim 7, wherein the contact portion is tapered, and a taper angle of the contact portion is less than or equal to an angle of the root portion of the bellows portion formed when the bellows portion is compressed maximally.

9. The inkjet printer according to claim 7, wherein the contact portion is rounded.

10. An inkjet printer comprising:

a main ink tank configured to store ink;

a subtank configured to store the ink supplied from the main tank and to be connected to the main tank when the ink is being supplied and to be disconnected from the main tank when the ink is not being supplied, the subtank having an expandable and contractible bellows portion;

a recording head configured to eject the ink supplied from the subtank onto a recording medium; and at least one deformation-preventing member configured to contact an outer surface of the bellows portion and configured to prevent the subtank from bulging in a direction intersecting with an expanding and contracting direction in which the subtank expands or contracts, wherein the at least one deformation-preventing member is supported by the bellows portion such that:

the at least one deformation-preventing member surrounds an outermost portion of the bellows portion, and the at least one deformation-preventing member moves together with the bellows portion when the subtank expands and contracts.

11. The ink jet printer according to claim 10, further comprising:

an ink supply pipe configured to convey ink to the subtank;

a subtank-side joint valve configured to be fixed to a main body of the recording head and communicate with the subtank;

a main-tank-side joint valve configured to be connected to the subtank-side joint valve and communicate the subtank to an ink cartridge;

a pushrod configured to push the end of a push lever; and a slide cam configured to operate the main-tank-side joint valve and the pushrod.

12. The inkjet printer according to claim 10, wherein the at least one deformation-preventing member divides the bellows portion into n-number of sections, and (n−1)-number of the at least one deformation-preventing member is positioned at least one position substantially equally spaced along the bellows portion, resulting in the n-number of sections.

13. The inkjet printer according to claim 10, wherein the at least one deformation-preventing member is disposed in a root portion of the bellows portion.

14. The inkjet printer according to claim 13, wherein a section of the at least one deformation-preventing member facing the bellows portion has a contact portion such that a dimension thereof parallel to the expanding and contracting direction decreases in a direction toward an interior of the ink tank.

15. The inkjet printer according to claim 14, wherein the contact portion is tapered, and a taper angle of the contact portion is less than or equal to an angle of the root portion of the bellows portion formed when the bellows portion is compressed maximally.

16. The inkjet printer according to claim 14, wherein the contact portion is rounded.

17. A deformation-preventing member comprising:

an outer portion; and an inner portion, wherein the inner portion is configured to contact an outer surface of a bellows portion of an ink tank, said deformation-preventing member configured to prevent the ink tank from bulging in a direction intersecting with an expanding and contracting direction in which the ink tank expands and contracts, wherein the at least one deformation-preventing member is configured to be supported by the bellows portion such that:

the at least one deformation-preventing member surrounds an outermost portion of the bellows portion, and the at least one deformation-preventing member moves together with the bellows portion when the ink tank expands and contracts.

18. The deformation-preventing member according to claim 17, wherein an angle formed by sides of the inner portion is less than or equal to an angle formed by surfaces of the bellows portion when the ink tank is contracted maximally.

19. The inkjet printer according to claim 1, wherein the at least one deformation-preventing member prevents a central portion of the ink tank in the expanding and contracting direction of the ink tank from bulging.

20. The inkjet printer according to claim 10, wherein the at least one deformation-preventing member prevents a central portion of the ink tank in the expanding and contracting direction of the ink tank from bulging.

* * * * *